United States Patent [19]

Hansell, III

[11] Patent Number: 4,773,878

[45] Date of Patent: Sep. 27, 1988

[54] SHIELDED FLAT CABLE CONNECTORS

[75] Inventor: George A. Hansell, III, Newark, Del.

[73] Assignee: W. L. Gore & Associates, Newark, Del.

[21] Appl. No.: 69,345

[22] Filed: Jul. 2, 1987

[51] Int. Cl.[4] ..... H01R 13/648

[52] U.S. Cl. ..... 439/497; 439/92; 439/610

[58] Field of Search ..... 439/92, 497, 607-610

[56] References Cited

U.S. PATENT DOCUMENTS

| | | | |
|---|---|---|---|
| 3,569,900 | 3/1971 | Uberbacker . | |
| 3,663,922 | 5/1972 | Foust et al. . | |
| 3,864,011 | 2/1975 | Huber . | |
| 3,963,319 | 6/1976 | Schumacher et al. . | |
| 4,035,050 | 7/1977 | Volinskie . | |
| 4,040,704 | 8/1977 | Huber . | |
| 4,076,365 | 2/1978 | Ross et al. . | |
| 4,094,564 | 6/1978 | Cacolica | 439/497 X |
| 4,236,779 | 12/1980 | Tang | 439/610 |
| 4,352,531 | 10/1982 | Gutter . | |
| 4,508,415 | 4/1985 | Bunnell | 439/497 |
| 4,662,700 | 5/1987 | Markham | 439/607 |
| 4,678,121 | 7/1987 | Douty et al. | 439/610 |

OTHER PUBLICATIONS

Cable Design and Interconnection System for Digital Pulse Transmission Cables, G. Hansell et al., 9th Ann. Conn. Sym., 10/76.

Interconnecting with Subminiature Digital Coax., G. Hansell et al., 14th Ann. Connector Sym. Proc., 11/81.

*Primary Examiner*—Eugene F. Desmond

*Attorney, Agent, or Firm*—Dena Meyer

[57] ABSTRACT

This invention relates to connectors for cables with prearranged spacing configurations between signal conductors and ground conductors thus allowing use of higher density cables for high speed electronic signals. Ground conductors are attached to the housing of the connector.

12 Claims, 4 Drawing Sheets

CROSSTALK DATA

TIME DOMAIN REFLECTOMETER TRACES

SHIELDED FLAT CABLE CONNECTORS

BACKGROUND OF THE INVENTION

1. Field of the Invention

This invention relates to connectors for cables with minute spacings between conductors and where alternate conductors are used as signal conductors and ground conductors thus allowing use of higher density cables for high speed electronic signals. Ground conductors are attached to the housing of the connector.

2. Description of the Prior Art

Miniaturization in the electronics industry, in addition to an ever-growing number of elements which can be placed on a circuit chip has generated a need for interconnection techniques that are also miniaturized. In addition to the miniaturization and increased quantity of elements to be interconnected, higher speed circuits require improved electrical properties of the interconnecting means. To satisfy these needs, precision spaced conductors in flat cables and miniaturized coaxial cables have been developed. A connector in the simplest terms is a device used to provide rapid, efficient, connect-disconnect service for electrical wire and cable termination.

Improvements to create higher quality cables for higher speed electronics have focused on coaxial cables in which the spacing between conductors has been reduced from 0.1 inch to about 0.05 inch. Existing technology provides coaxial cable having an individual ground associated with each signal conductor that is generally terminated in a manner in which shield integrity is maintained throughout the connector.

BRIEF DESCRIPTION OF THE INVENTION

The present invention provides connector assemblies which have prearranged spacing configurations and ground conductor attachment to housing shells allowing for the use of higher density cables for high speed electronics.

The electrical connector for flat cable with a plurality of signal and ground conductors comprises a movable connector section having a socket assembly with at least one row of regularly spaced signal contact pins and sockets, a plurality of signal conductors and ground conductors with a spacing arrangement so that the ground conductors are attached to the ground shell and the signal conductors are affixed to the socket assembly by joining to the signal contact pins, a shell enclosing the movable connector and a fixed connector section comprising an insulated housing having an array of mating contacts and at least one row of springy fingers. The fixed connector section is affixed to the movable connector section by means of mating contacts to sockets.

The present invention provides a capability of increased socket positions and increased signal contacts within a certain area.

DETAILED DESCRIPTION OF THE INVENTION

This invention relates to wire and cable connector assemblies which have prearranged regular spacing configurations and ground conductor attachment to housing shells thus allowing for the use of higher density cables for high speed electronics. The spacing arrangements allow for miniaturization and the ability to increase the number of elements to be interconnected without compromising electrical properties.

Figure 1:
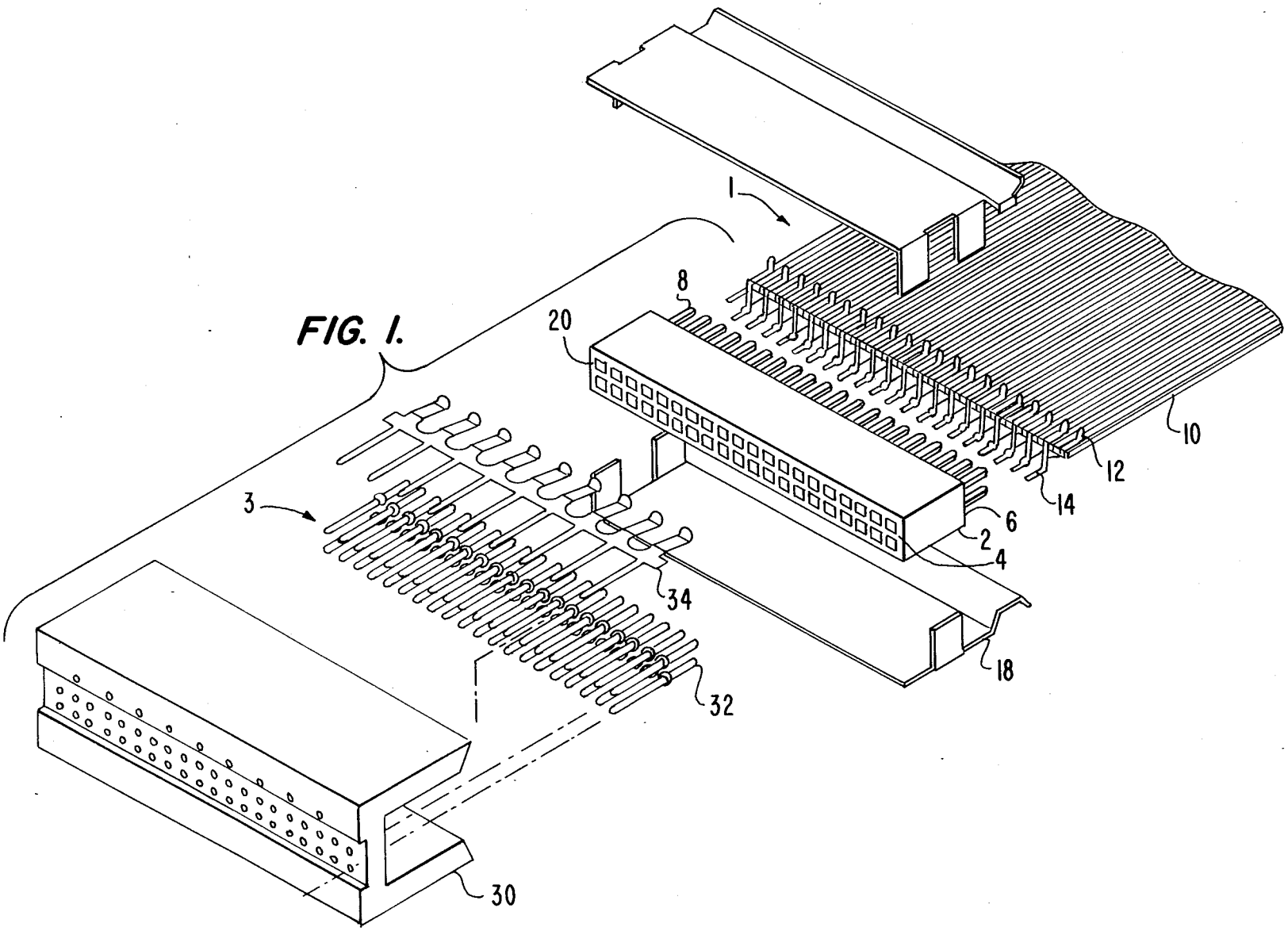
FIG. 1 shows an exploded view of the flat cable and connector sections.

The herein disclosed embodiments of the invention are particularly intended for use on flat ribbon cable 10 as shown in FIG. 1 and comprise a plurality of conductors in side by side parallel relationship in which alternate conductors are used as signal conductors 14 and ground conductors 12.

The connectors of this embodiment are comprised of two halves, one identified as a movable connector 1 and the other identified as either the fixed half of the connector or the header 3.

The movable connector half 1 is further comprised of a socket assembly 2, grounding shells 16 and 18 and flat ribbon cable 10 affixed to the socket assembly 2 and shell 16 in a prearranged spacing configuration described below. The flat ribbon cable 10 is comprised of a plurality of isolated signal conductors 14 positioned so that there at least one ground conductor 12 between two adjacent signal conductors 14.

In a preferable cable, all of the conductors of the cable 10 are on 0.0125 inch center lines. The signal conductors 14, in their assembled position therefore have at least a space of 0.025 inch between them.

Figure 2:
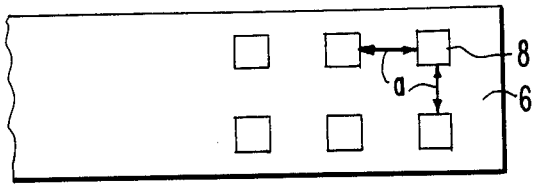
FIG. 2 shows the front face of the socket assembly in the preferred spacing arrangement.

The socket assembly 2 is commercially available from E. I. DuPont de Nemours, Inc., AMP, Inc., or ITT Cannon. The socket assembly 2 is a plastic housing having two faces, namely, front face 4 and rear face 6. An array of sockets 20 are accessible from the front face 4 and a corresponding array of signal contact pins B protrude from the rear face 6. The preferable spacing of the signal contact pins 8 have 0.050 inch between each other and between each of two rows which corresponds to the spacing of the signal conductor spacing discussed above. FIG. 2 shows the preferred spacing arrangement as designated by the letter "a".

Figure 3:
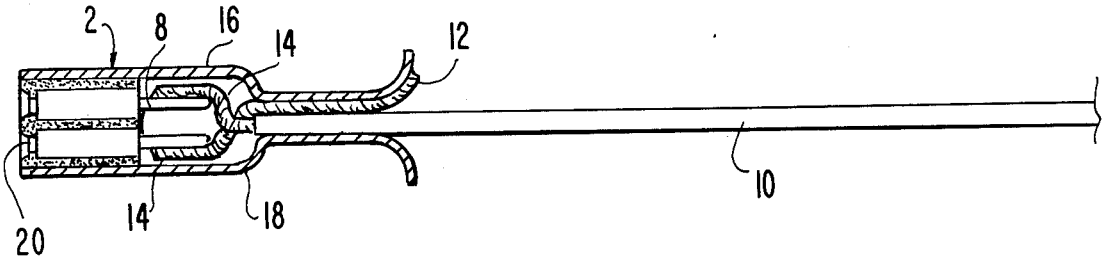
FIG. 3 shows a side view of a signal conductor attached to a signal contact pin.

FIG. 3 shows the signal conductors 14 as attached to the signal contact pins 8 preferably by means of soldering. They may also be attached by a metal filled adhesive or other materials so that electrical conductivity and mechanical integrity are maintained.

Insulation covering the conductors of the flat ribbon cable 10 is minimized and is preferably kept to a thickness of approximately 0.01 inch.

The upwardly bent ground conductors 12 of the ribbon cable 10 are affixed directly to the grounding shell upper half 16 which surrounds the region of attachment between the socket assembly 2 and the flat ribbon cable 10. The use of this unique grounding configuration allows the socket 20 to be used solely for the signal conductors 14 thus increasing the overall signal capacity of the connector. An additional feature of this configuration is the improved electrical signal transmission.

The ground conductors 12 are preferably attached to the grounding shell 16 by soldering. Other means for attaching the ground conductors 12 to the grounding shell 16 include spot welding and the use of a conductive adhesive such as metal-filled epoxy.

A lower half of the grounding shell 18 covers the lower half of the movable connector 1, thus enclosing the signal conductors 14 and contact pins 8 and providing increased strain relief to the connector. Both parts of the grounding shells 16 and 18 are formed from thin sheet metal and are designed to fit closely around the socket assembly 2 and terminating area of the flat ribbon cable 10 as shown in FIG. 1. The parts of the grounding shells 16 and 18 may either fit snugly or have ends that overlap to prevent separation of the shell parts and to provide electrical continuity between the two halves. Other means for attaching the shell parts together include the use of an adhesive.

FIG. 3 shows a cross-sectional side view of the assembled movable connector part, wherein flat ribbon cable 10 with a thin layer of insulation is joined with the socket assembly 2 at the signal contact pin 8. At the joint, signal conductor 14 is soldered to signal contact pin B. Ground conductor 12 is bent upward and soldered to the upper half of the ground shell 16. The lower half of the ground shell 18 covers the bottom of the conductor-contact joint to fully enclose it and make electrical contact with the upper half of the ground shell 16. The enclosure formed by the shells may optionally be filled with a material such as plastic to provide environmental protection.

Figure 4:
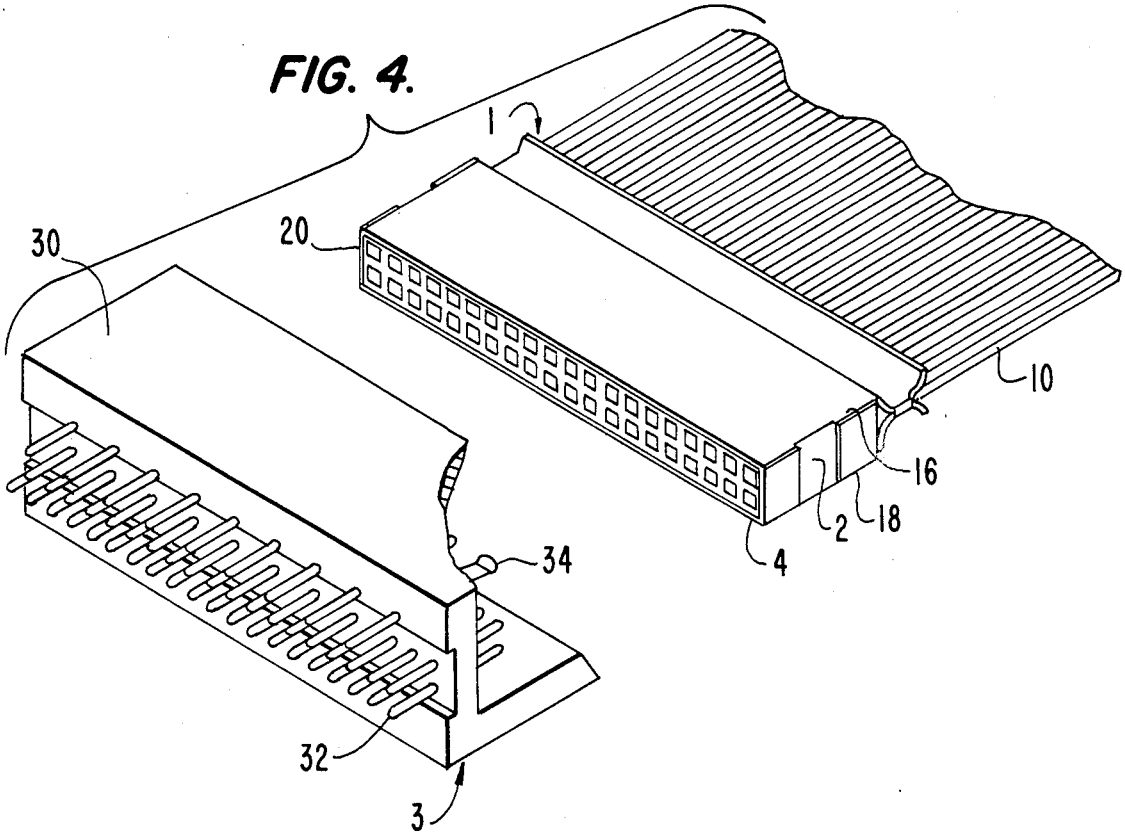
FIG. 4 shows an perspective view of the fixed connector half and the movable connector half.

FIG. 4 shows a perspective of the movable connector part 1, fully assembled, and the fixed connector part 3. The lower part of the ground shell 18 meets with the upper part 16 to fully surround the socket assembly 2 and the region of the ribbon cable comprising the signal conductor-contact joint. The perspective also shows the sockets 20 of the socket assembly 2 which are used to mate with mating contacts 32 of the header 3.

FIG. 1 also shows the exploded view of the fixed half of the connector also identified as the header 3. This is further comprised of an insulated housing 30 within which are located an array of two parallel rows of mating contacts 32. The mating contacts 32 are spaced to fit within sockets 20 of the movable connector part 1 when the connector is fully assembled.

Figure 5A:
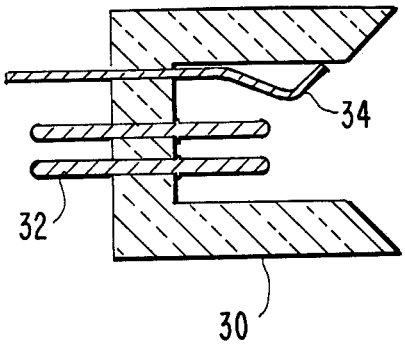
FIG. 5*a* shows a side view of the fixed connector half with a single springy finger.

FIG. 1 also shows a row of springy fingers 34 contained within the insulated housing 30 and located above the array of mating contacts 32. The single row of springy fingers 34 and array of mating contacts 32 are preferably arranged so that there is a 50 mil space between each row. The springy fingers serve the purpose of electrically and mechanically contacting the ground shell 16 and 18. FIG. 5*a* shows a cross-section side view of a single springy finger 34 (part of a row of springy fingers) shown above the mating contacts 32 within the housing 30.

The insulated housing 30 shown in FIGS. 1 and 3 is preferably constructed from a thermoplastic and has an overall width of approximately 0.2 inch. Combined with the preferable spacing of 0.050 inch for each of the two signal contact rows, a capability of 40 signal positions per inch is achieved. A cable assembly is thereby provided having 200 signal contacts for each square inch of area used on the substrate to which the fixed half 3 of the connector is mounted.

Figure 5B:
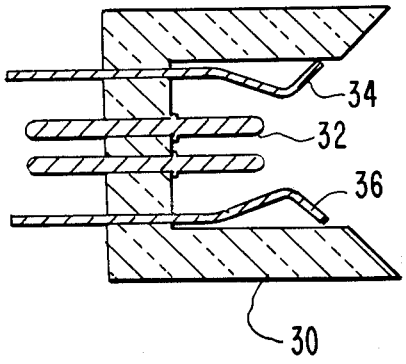
FIG. 5*b* shows a side view of the fixed connector half with two springy fingers.

An alternative embodiment to the single row of springy fingers 34 includes having a second row of springy fingers 36 also within the insulated housing 30 and located below the array of mating contacts. FIG. 5*b* shows a side view of this alternative wherein springy fingers are located above and below mating contacts 32. Alternate designs where spacing may not be critical can also be used.

Figure 6:
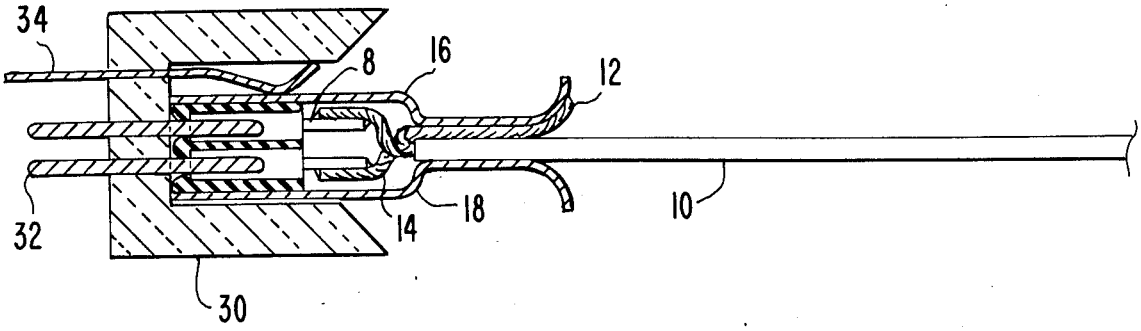
FIG. 6 shows a cross-sectional view of the mating contacts joined within the sockets of the movable connector half.

FIG. 6 shows a cross-sectional side view of the mated joining of the header 3 and the movable connector half 1 in which the mating contacts 32 of the header 3 fit within the sockets 20 of the movable connector half thus making electrical contact.

The following example discloses the inventive product and method of use. This is intended to be illustrative only and not intend to limit the scope of the present invention in any way.

EXAMPLE 1

A connector was made in accordance with the invention using a cable having conductors with 0.008 inch diameters. There were 40 signal conductors and 41 ground conductors in the cable wherein each signal conductor was positioned between two ground conductors. Conductor spacing was 0.0125 inch center to center. The 40 signal conductors were terminated to 40 signal contacts. The 40 signal contacts were then connected to 40 mating socket contacts thus providing a total of about 200 signal contacts per square inch as the fixed connector part measured about 0.2 inch by 1.0 inch. Nine springy fingers were used to connect with the ground conductors.

Figure 7:
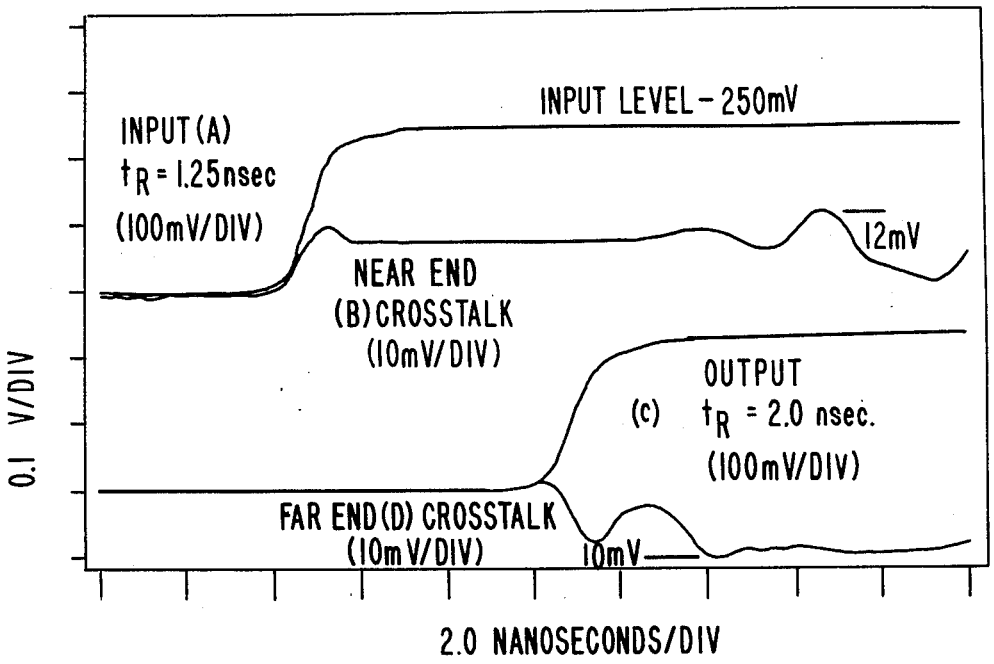
FIG. 7 shows cross talk data traces.
Figure 8:
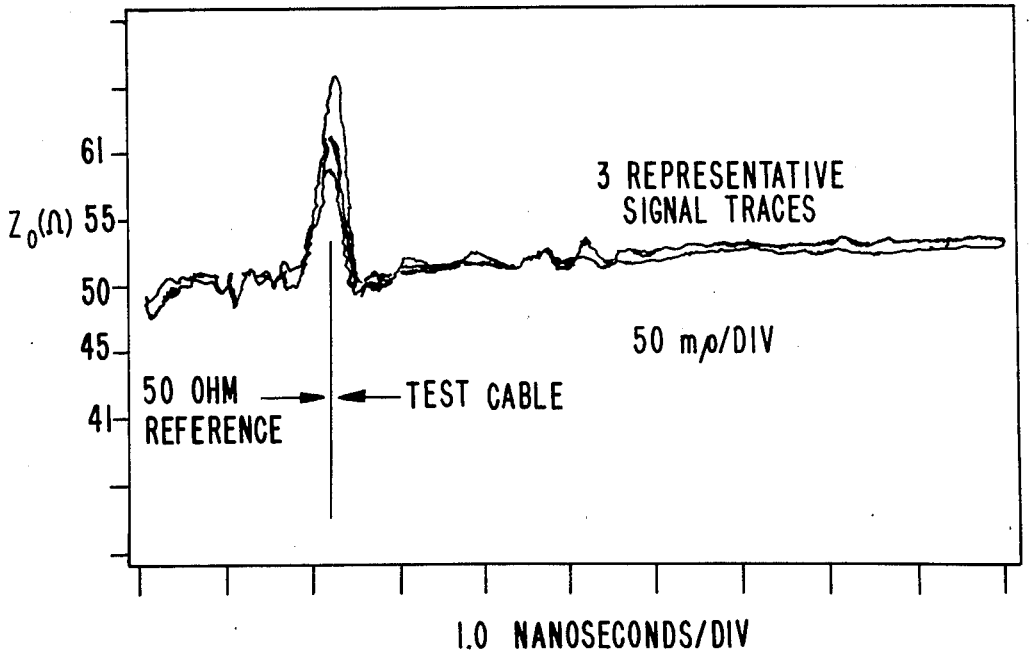
FIG. 8 shows a time domain reflectometer trace.

This connector assembly was tested by first putting a 150 pico-second rise time signal through the system. The discontinuity at the connector interface was approximately 150 millirho. A second electrical test on the same conductor was performed by sending a signal with a 1.25 nanosecond rise time through the entire assembly. This signal had a 250 millivolt level. One signal line was driven and the adjacent line was sensed for cross talk with near end cross talk measuring approximately 12 millivolts and far end cross talk approximately 10 millivolts. FIG. 7 show results of the cross talk at the near end and far end. FIG. 8 shows the time domain reflectometer traces.

While the invention has been disclosed herein in connection with certain embodiments and detailed description, it will be clear to one skilled in the art that modifications or variations of such details can be made without deviating from the gist of the invention and such modifications or variations are considered to be within the slope of the claims herein below.

We claim:

1. An electrical connector for flat cable with a plurality of signal and ground conductors which comprises:

(a) a movable connector section, including a socket assembly with a front and back face having at least one row of spaced signal contact sockets accessible from the front face and a corresponding array of signal contact pins protruding from the rear face; the plurality of signal conductors and ground conductors having a spacing configuration in which said ground conductors are bent upwards and said signal conductors are affixed to said socket assembly by mating with signal contact pins;

(b) an upper and lower shell to which said ground conductors are affixed enclosing said movable connector;

(c) a fixed connector section including an insulated housing containing an array of mating contacts and at least one row of springy fingers wherein said fixed connector section is affixed to said movable connector section by means of connecting said mating contacts to said sockets and said shells to said springy fingers.

2. An electrical connector of claim 1 wherein one ground conductor is positioned adjacent to each signal conductor.

3. An electrical connector of claim 1 wherein said ground conductors are affixed to said shell by soldering means.

4. An electrical connector of claim 1 wherein said ground connectors are affixed to said shell by means of an electrically conductive adhesive.

5. An electrical connector of claim 4 wherein said signal conductors are affixed to said signal contacts by soldering.

6. An electrical connector of claim 1 wherein said signal conductors are affixed to said signal contacts by an electrically conductive adhesive.

7. An electrical connector of claim 1 wherein said fixed connector section has two rows of springy fingers.

8. An electrical connector of claim 1 wherein space between said shells enclosing said movable connectors is filled with a material to provide environmental protection.

9. An electrical connector of claim 8 wherein the material filled between said shells is plastic.

10. An electrical connector of claim 1 where the socket assembly consists of two rows of regularly spaced sockets.

11. An electrical connector of claim 10 where the spacing between said sockets is about 0.05 inch both in the rows and between the rows.

12. An electrical connector of claim 11 where the overall dimensions of fixed connector section is about 0.2 inch by 1.0 inch.

* * * * *